US008049091B2

(12) United States Patent
Hagemeyer et al.

(10) Patent No.: US 8,049,091 B2
(45) Date of Patent: Nov. 1, 2011

(54) WIRELESS RECEIVER

(75) Inventors: Frank Hagemeyer, Wedemark (DE); Stefan Thien, Surwold (DE); Stephan Scherthan, Lindwedel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 20 days.

(21) Appl. No.: 12/396,231

(22) Filed: Mar. 2, 2009

(65) Prior Publication Data

US 2010/0218661 A1 Sep. 2, 2010

(51) Int. Cl.
*G10G 7/02* (2006.01)

(52) U.S. Cl. ..... 84/454; 84/455; 84/600

(58) Field of Classification Search ..... 84/454, 84/455, 600–602
See application file for complete search history.

(56) References Cited

U.S. PATENT DOCUMENTS

| | | | | |
|---|---|---|---|---|
| 4,320,689 | A * | 3/1982 | Pogoda | 84/454 |
| 4,365,537 | A * | 12/1982 | Pogoda | 84/454 |
| 5,388,496 | A * | 2/1995 | Miller et al. | 84/454 |
| 6,278,047 | B1 * | 8/2001 | Cumberland | 84/455 |
| 6,415,584 | B1 * | 7/2002 | Whittall et al. | 84/312 R |
| 6,479,738 | B1 * | 11/2002 | Gilmore | 84/454 |
| 7,655,851 | B2 * | 2/2010 | Nagakura | 84/312 R |
| 7,732,703 | B2 * | 6/2010 | Lazovic | 84/645 |
| 7,842,875 | B2 * | 11/2010 | Villa et al. | 84/609 |
| 2003/0172797 | A1 * | 9/2003 | Juszkiewicz et al. | 84/601 |
| 2004/0025672 | A1 * | 2/2004 | Carpenter | 84/622 |
| 2004/0139841 | A1 * | 7/2004 | Capano | 84/454 |
| 2004/0144235 | A1 * | 7/2004 | Taku | 84/454 |
| 2004/0144239 | A1 * | 7/2004 | Sakurada | 84/616 |
| 2005/0087060 | A1 * | 4/2005 | Taku et al. | 84/455 |
| 2006/0065107 | A1 * | 3/2006 | Kosonen | 84/616 |
| 2007/0079694 | A1 * | 4/2007 | Pakzad | 84/723 |
| 2007/0084328 | A1 * | 4/2007 | Kashioka | 84/413 |
| 2008/0006140 | A1 * | 1/2008 | Adams | 84/455 |
| 2008/0229905 | A1 * | 9/2008 | Lau et al. | 84/454 |
| 2008/0229907 | A1 * | 9/2008 | Clark | 84/454 |
| 2009/0288547 | A1 * | 11/2009 | Lazovic | 84/645 |

* cited by examiner

*Primary Examiner* — David S. Warren
(74) *Attorney, Agent, or Firm* — Kilpatrick Townsend & Stockton LLP

(57) ABSTRACT

A wireless receiver for receiving a wireless transmitted audio signal from a wireless transmitter is provided. The wireless receiver comprises a tuning assisting unit for assisting in the tuning of a music instrument coupled to the wireless transmitter. The tuning assisting unit indicates whether the audio signal from the music instrument corresponds to a specified frequency. The wireless receiver furthermore comprises an audio amplifier for amplifying the received audio signal. The wireless receiver furthermore comprises a housing which incorporates the tuning assisting unit and the audio amplifier.

5 Claims, 2 Drawing Sheets

WIRELESS RECEIVER

The present invention relates to a wireless receiver.

During concerts or an audio recording, wireless transmitters are often used in connection with musical instruments, like violins, guitars, bass guitars or the like. The sound produced by the music instruments are transmitted by means of the wireless transmitters to wireless receivers. The wireless receivers will forward the wireless transmitted audio signals to a subsequent audio processing.

Certain music instruments like string instruments, guitars, bass guitars, violins etc. must be tuned regularly, sometimes they even have to be retuned during concerts.

It is an object of the invention to provide a wireless receiver which enables an improved tuning of musical instruments.

This object is solved by a wireless receiver according to claim 1.

Therefore, a wireless receiver for receiving a wireless transmitted audio signal from a wireless transmitter is provided. The wireless receiver comprises a tuning assisting unit for assisting in the tuning of a music instrument coupled to the wireless transmitter. The tuning assisting unit indicates whether the audio signal from the music instrument corresponds to a specified frequency. The wireless receiver furthermore comprises an audio amplifier for amplifying the received audio signal. The wireless receiver furthermore comprises a housing which incorporates the tuning assisting unit and the audio amplifier.

According to a further aspect of the invention, the tuning assisting unit comprises an analog amplifier unit having at least one first and second operational amplifier, eight resistors and five capacitors.

According to a further aspect of the invention, the tuning assisting unit receives an analog signal of a music instrument as input signal and determines a corresponding digital signal, wherein the zero crossings of the input analog signal relate to the zero crossings of the output digital signal.

The invention relates to the idea to integrate a tuning assisting unit into a wireless receiver cooperating with a wireless transmitter which is coupled to a musical instrument. The tuning assisting unit is used to assist the tuning of a music instrument coupled to the wireless transmitter. A wireless receiver, which comprises a tuning assisting unit is advantageous as no cable needs to be provided between the wireless receiver and an external tuning device. Furthermore, as no cable needs to be provided, any possible operation error can be avoided. While in tuning units according to the prior art, a separate audio amplifier needs to be provided, integrated tuning units can also reuse the audio amplifier of the wireless receiver.

Further aspects of the invention are defined in the dependent claims.

Embodiments and advantages of the present invention will now be described in more detail with reference to the figures.

Figure 1:
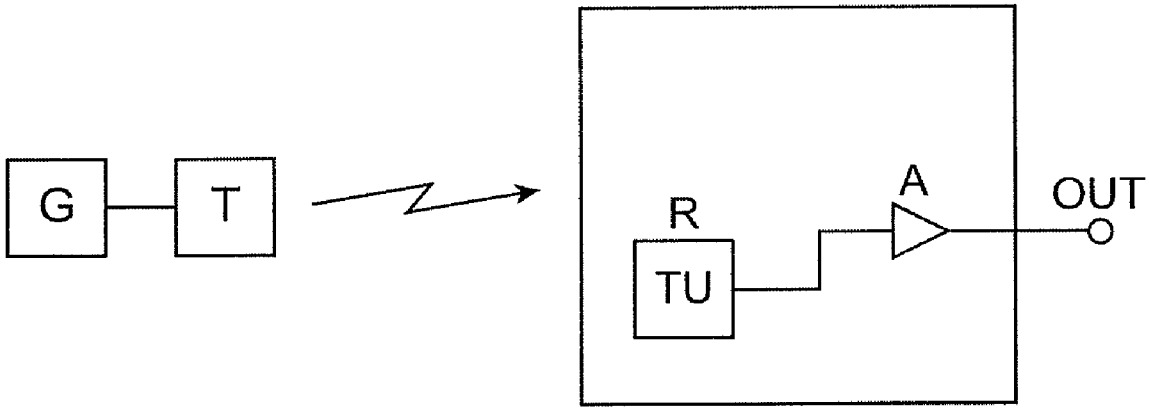
Figure 2:
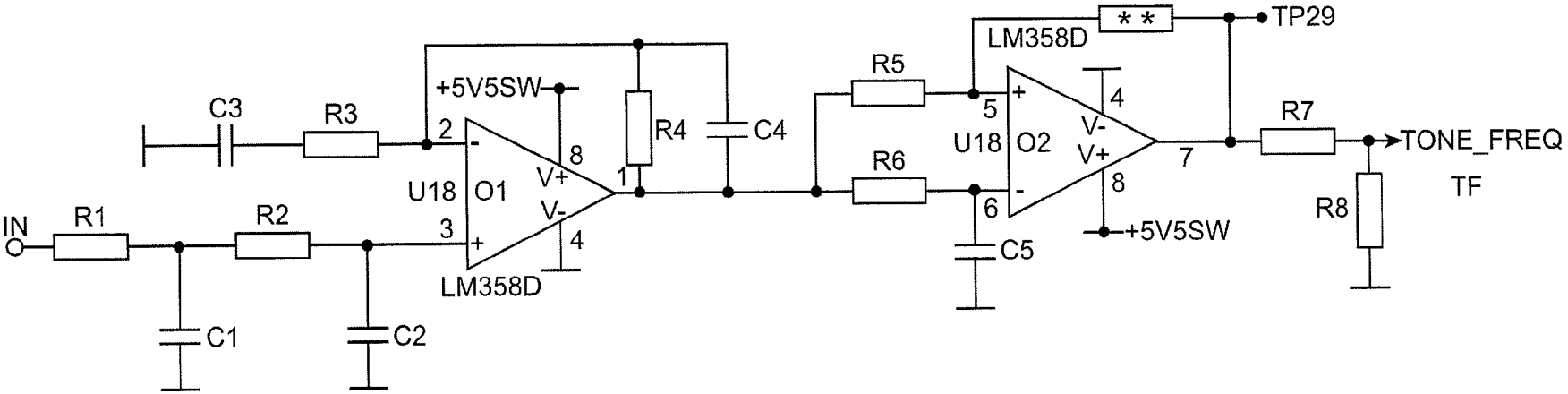

FIG. 1 shows a block diagram of a wireless audio signal transmitting system according to a first embodiment, and FIG. 2 shows a circuit diagram of a tuning unit according to the first embodiment.

FIG. 1 shows a block diagram of a wireless audio signal transmitting system according to a first embodiment. A music instrument G can be coupled to the wireless transmitter T which is enabled to wireless transmit an audio signal from the music instrument G. Furthermore, a wireless receiver R is provided which receives the wireless transmitted audio signal from the transmitter T. The wireless receiver R also comprises a tuning assisting unit TU as well as an audio amplifier A. The output of the audio amplifier A serves as output signal OUT. The tuning assisting unit TU serves for assisting a tuning of the music instrument G.

The music instrument can for example be a string instrument, a guitar, a bass guitar, a violin or any other music instrument which needs to be tuned.

The tuning assisting unit TU receives an analog signal from the music instrument (transmitted via the wireless transmitter and received by the wireless receiver) and converts the analog signal into a digital signal having high and low levels such that the output signal can be processed by a digital signal processor. The tuning assisting unit TU serves to remove the amplitude information but to maintain the zero crossings of the signal. Based on the zero crossings, the frequency of the signal can be determined. The output of the tuning assisting unit relates to the frequencies of the audio signal from the music instrument. However, it should be noted that the audio signal from the music instrument not only comprises the fundamental waves but also harmonics thereof. In a subsequent processing, the fundamental signal has to be determined even in the presence of the harmonics.

The input analog signal may comprise several fundamental signals and harmonics thereof.

The output signal OUT of the tuning assisting unit TU is a square wave signal.

The tuning assisting unit receives the analog signal from the music instrument as input signal and outputs a digital signal which peeks are compatible with a subsequent digital signal processor. The output signal of the tuning assisting unit TU has a low and a high level. The frequency information of the audio signal from the music instrument is present in the zero crossings. In other words, the time from a rising edge to the next rising edge will correspond to one period of the signal. As several harmonics may be present, a subsequent digital signal processor must determine which rising edges relate to a fundamental signal.

FIG. 2 shows a circuit diagram of a tuning assisting unit according to a first embodiment. The tuning assisting unit comprises a first and second operation amplifier O1, O2, an input IN as well as an output TF. The output signal TF corresponds to the tone frequency, i. e. the frequency of a tone from the music instrument. Furthermore, the tuner assisting unit comprises eight resistors R1-R8, five capacitors C1-C5 as well as two operation amplifiers O1, O2. The first and second resistors R1, R2 are coupled in series between the input terminal IN and one input terminal of the first operational amplifier O1. A first capacitor C1 is coupled between the first and second resistor R1, R2 and ground. The second capacitor C2 is coupled between the second resistor R2 and a first input of the first operational amplifier O1. A third capacitor C3 and a third resistor R3 is coupled between ground and a second input of the first operational amplifier O1. A fourth resistor R4 and a fourth capacitor C4 are coupled in parallel between the second input and the output of the first operational amplifier O1. A fifth resistor R5 is coupled between the output of the first operational amplifier and one input of the second operational amplifier O2. A sixth resistor R6 is coupled between the output of the first operational amplifier O1 and an input of the second operational amplifier. A fifth capacitor C5 is coupled between the sixth resistor R6 and an output of the second operational amplifier as well as to ground. A seventh and eighth resistor R7, R8 is coupled between the output of the second operational amplifier and ground. The output TF of the tuning unit is coupled between the seventh and eighth resistor R7, R8. The output of the tuning assisting unit TF corresponds to the tone frequency.

The output signal OUT of the tuning assisting unit TU is a square wave signal.

The wireless receiver can comprise a housing, a power supply unit, an audio processing unit, a processor and optionally a display. As mentioned above, the tuning assisting unit can be realised with eight resistors, five capacitors and two operational amplifiers or a double-operational amplifier. The first operational amplifier can be used as a pre-amplifier with a bandwidth of 60 Hz-400 Hz, the second operational amplifier can be used as a limiting amplifier. This limiting amplifier serves to provide an output voltage at approximately 3 Vss independent on the value of the input signal. The frequencies of the input signal will all be included in the output signal. The output signal of the limiter can be provided to a digital input of a system processor.

The signal of the music instrument typically comprises several harmonics, like second to fourth harmonics. Sometimes these harmonics can be higher than the fundamental wave. As an example, tone "A" has a ground frequency of 110 Hz, the tone "E" has a ground frequency of 82.5 Hz. The second, fourth, eighth etc. harmonics of a tone is the same tone. However, it should be noted that the third harmonics is another tone. Accordingly, for a guitar, the fourth harmonics of the E-cord with 330 Hz has the same frequency as the third harmonics of an A-cord.

Accordingly, in any subsequent audio processing, the ambiguity of the harmonics must be dealt with.

The circuit of the tuning assisting unit is very simple and is also very cheap such that an integrated tuning unit can be provided for a wireless receiver.

At the input IN the tuning assisting unit TU receives the signal of the music instrument. The first operational amplifier O1 serves as an amplifier with a bandpass characteristic. The second operational amplifier O2 is in an open-loop gain operation without a negative feedback. The second operational amplifier O2 supplies the limited output signal TF which corresponds to the tone frequency to a subsequent audio processing.

In an alternative embodiment, the tuning assisting unit can also be implemented or realised by means of a digital signal processor.

In a further embodiment, the tuning unit as described above can also be implemented in a wireless transmitter to which a music instrument can be coupled to.

The receiver R may optionally comprise a display for displaying the output results of the tuning assisting unit, i. e. whether a tone for a music instrument corresponds to a present frequency (a present tone).

The invention claimed is:

1. A wireless receiver for receiving a wireless transmitted audio signal from a wireless transmitter, the wireless receiver comprising:

a tuning assisting unit for assisting in tuning a musical instrument coupled to the wireless transmitter and for indicating whether the audio signal from the music instrument corresponds to a specified frequency, wherein the audio signal is received by the tuning unit as an analog signal;

an audio amplifier for amplifying the wireless received audio signal, wherein the tuning assisting unit reuses the audio amplifier of the wireless receiver;

an output for outputting an output signal of the audio amplifier and an output signal of the tuning assisting unit; and a housing which incorporates the tuning assisting unit and the audio amplifier.

2. The wireless receiver according to claim 1, wherein the tuning assisting unit comprises an operational amplifier unit having at least a first and a second operational amplifier, eight resistors and five capacitors.

3. The wireless receiver according to claim 1, wherein the tuning assisting unit receives an analog audio signal from a music instrument as input signal and determines a digital signal based on the audio signal, wherein the digital signal comprises information with respect to zero crossings of the analog signal.

4. The wireless receiver according to claim 1, wherein the tuning assisting unit determines based on the zero crossings of the digital output signal at least one frequency in the analog signal of the music instrument based on the information of the zero crossings.

5. The wireless receiver of claim 1, wherein the output signal comprises rising edges, further wherein a digital signal processor determines which rising edges relate to a fundamental signal from the musical instrument.

* * * * *

UNITED STATES PATENT AND TRADEMARK OFFICE

CERTIFICATE OF CORRECTION

PATENT NO. : 8,049,091 B2
APPLICATION NO. : 12/396231
DATED : November 1, 2011
INVENTOR(S) : Hagemeyer et al.

It is certified that error appears in the above-identified patent and that said Letters Patent is hereby corrected as shown below:

In the Specification:

Column 1, Line 6: please place a --,-- after “bass guitars”.

Column 1, Line 12: please place a --,-- after “etc.”.

Column 1, Line 12: please delete the “,” after “regularly” and insert a --;-- after that word.

Column 1, Line 28: please place a --,-- after “housing”.

Column 1, Line 36: before “input signal” please insert --an--.

Column 1, Line 41: please place a --,-- before “which”.

Column 1, Line 44: please place a --,-- after “assisting unit”.

Column 1, Line 61: please place a --,-- after “transmitting system”.

Column 1, Line 62: please place a --,-- after “transmitter T”.

Column 1, Line 63: please delete “wireless transmit” and insert --wirelessly transmit--.

Column 1, Line 65: please delete “wireless transmit” and insert --wirelessly transmit--.

Column 2, Line 4: please place a --,-- after “can”.

Column 2, Line 4: please place a --,-- after “example”.

Column 2, Line 5: please place a --,-- after “violin”.

Column 2, Line 6: please replace “which” with --that--.

Column 2, Line 13: please delete “but” and insert --and--.

Column 2, Line 28: before “input signal” please insert --an--.

Column 2, Line 29: please delete “which peeks” and insert --whose peaks--.

Column 2, Line 42: please place a --,-- after “i.e.”.

Column 2, Line 49: please delete “resistor” and insert --resistors--.

Column 2, Line 52: please delete “is” and insert --are--.

Column 2, Line 63: please delete “is” and insert --are--.

Signed and Sealed this
Eighth Day of January, 2013

David J. Kappos

David J. Kappos
*Director of the United States Patent and Trademark Office*

Column 2, Line 66: please delete “resistor” and insert --resistors--.

Column 3, Line 9: please delete the “,” after “400 Hz” and insert a --;--.

Column 3, Line 11: please delete “on” and insert --of--.

Column 3, Line 19: please delete “Hz, the tone” and insert --Hz; the tone--.

Column 3, Line 21: please delete “is” and insert --are--.

Column 3, Line 21: please place a --,-- after “eighth”.

Column 3, Line 21: please place a --,-- after “etc.”.

Column 3, Line 22: please replace “third harmonics” with --third harmonic--.

Column 3, Line 23: please replace “fourth harmonics” with --fourth harmonic--.

Column 3, Line 26: please place a --,-- after “output signal TF”.

Column 4, Line 2: please place a --,-- after “i.e.”.